United States Patent [19]

Schwartz et al.

[11] Patent Number: 4,492,558

[45] Date of Patent: Jan. 8, 1985

[54] SMOKELESS WASTE GAS BURNING USING LOW PRESSURE STAGED STEAM

[75] Inventors: Robert E. Schwartz; Michael R. Keller, both of Tulsa, Okla.

[73] Assignee: John Zink Company, Tulsa, Okla.

[21] Appl. No.: 494,941

[22] Filed: May 16, 1983

[51] Int. Cl.[3] ..... F23D 13/20

[52] U.S. Cl. ..... 431/4; 431/89; 431/202

[58] Field of Search ..... 431/190, 89, 4, 5, 202, 431/76; 137/455, 458, 119

[56] References Cited

U.S. PATENT DOCUMENTS

| | | | |
|---|---|---|---|
| Re. 31,215 | 4/1983 | Stranahan et al. | 431/202 |
| 3,162,236 | 12/1964 | Williams | 431/202 |
| 3,779,689 | 12/1973 | Reed et al. | 431/5 |
| 3,829,275 | 8/1974 | Stranahan et al. | 431/202 |
| 3,861,855 | 1/1975 | Seider | 431/76 |
| 4,094,632 | 6/1978 | Reed et al. | 431/190 |
| 4,342,550 | 8/1982 | Tuck | 431/202 |

*Primary Examiner*—Samuel Scott
*Assistant Examiner*—Helen Ann Odar
*Attorney, Agent, or Firm*—Head, Johnson & Stevenson

[57] ABSTRACT

Flare stack burning of waste gases utilizes available low pressure steam by sequential steam injection as a function of the demand for smokeless combustion.

3 Claims, 2 Drawing Figures

SMOKELESS WASTE GAS BURNING USING LOW PRESSURE STAGED STEAM

BACKGROUND OF THE INVENTION

This invention lies in the field of smokeless combustion of waste gases in flare stacks. More particularly it concerns method and apparatus for utilizing low pressure steam as a smoke suppressant in the burning of waste gases. Smoke results because of the presence of free carbon as it escapes from the combustion zone. A result of injecting water or steam into the heated zone of burning hydrocarbons is based on typical reforming chemistry equation:

$$CH_4+H_2O=CO+3H_2$$

especially where the water is in vapor phase. One factor in suppression of smoke is through the reaction as shown, where carbon is combined with oxygen to form carbon monoxide, which is both invisible and rapid burning. Significantly, and perhaps more important are other factors such as inspiration of air caused by the steam injection plus the resultant turbulence and time of reaction to supress smoke.

Many refineries and gas process plants have low pressure steam (e.g. 10 to 50 psig) available. Typically, such steam is normally exhausted to the atmosphere. Energy costs now demand conservation and use of such steam. Heretofore low pressure steam was rarely used as a smoke suppressant in flares unless special equipment was created to pre-mix the steam and waste gas, as typically shown in U.S. Pat. Nos. 3,973,899; 4,152,108. Other background patents are U.S. Pat. Nos. 3,749,546 and 3,887,324.

A problem exists in the use of low pressure steam where it is injected as a function of demand for smoke suppressant. That is, high demand requires high steam flow and low demand a lesser steam flow. In those instances, where steam flow is at a maximum rate for a given design, the corresponding pressure drop across the injector (e.g. 30 p.s.i.g. available steam source) is such that the amount of energy available will promote smokeless burning. But where the demand for steam becomes less, the pressure drop across the injector is less and is thus ineffective to suppress smoke.

Another factor in the smoke suppressant art is the design of the steam injection orifices or nozzles so as to make maximum use of the available steam pressure. The pressure of the steam is directly relative to its potential mechanical kinetic energy and hence the penetrafility of steam and inspirated air into the burning gases for smokeless burning. The most difficult point of operation is at or below of the mechanical kinetic energy of a given orifice's sonic exit velocity. Below this point of operation efficiency of smoke suppression becomes very poor.

SUMMARY OF THE INVENTION

It is a primary object of this invention to provide a method and apparatus for the staged injection available of low pressure steam into burning hydrocarbon gases, for the purpose of smoke suppression.

Another object of the invention is to provide a low pressure steam-flare system which will operate for greater lengths of time at or above the sonic exit velocity.

A still further object of the invention is to provide a plurality of stages for injecting low pressure steam into a burning waste gas stream. A first stage operates to its capacity then a second stage is brought into use at an acceptable steam pressure and hence available mechanical kinetic energy.

The objects are obtained by a system where waste gases are burned usually above the tip of an elevated flare stack. A plurality of separated steam manifolds include nozzle or orifice means to inject steam. The design of the nozzles or orifices are such as to take maximum advantage of the steam pressure available. A primary steam supply is controlled by a modulating valve which opens as a function of need for steam. A separate inlet goes to each steam manifold. All but the first stage manifold include mechanical on-off valves which are controlled by a predetermined pressure or flow existing in the primary steam supply downstream of the modulating valve.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practised or carried out in a variety of ways. Also it is to be understood that the phraseology or terminology employed herein is for the purpose of description and not of limitation.

Figure 1:
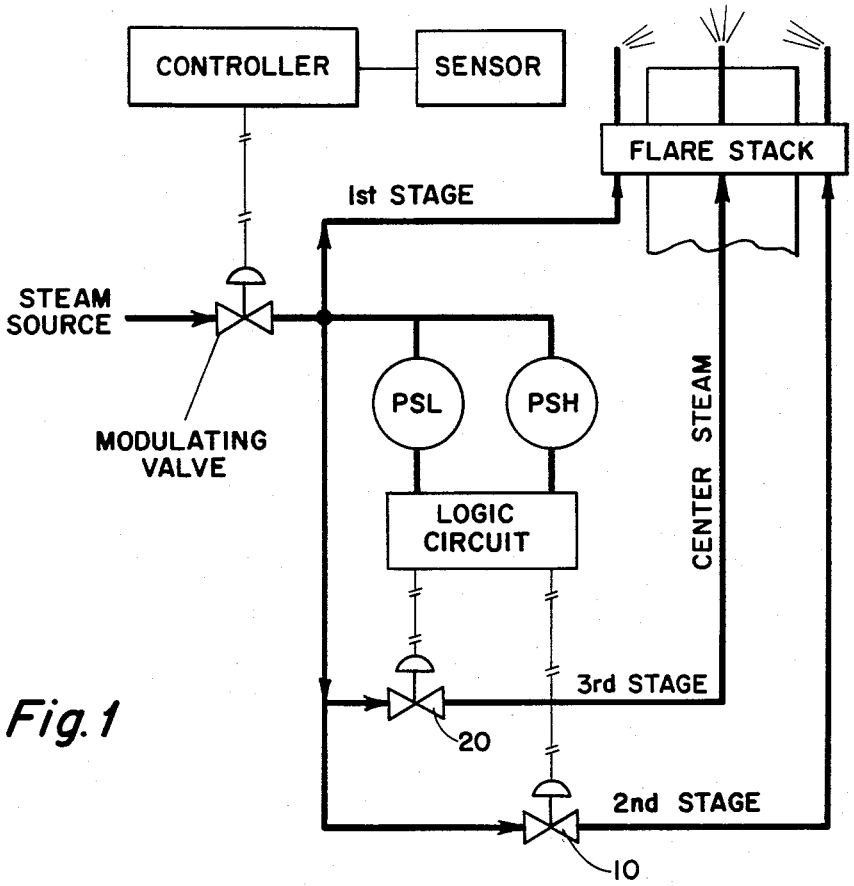
FIG. 1 is a schematic diagram of the invention.

Referring now to FIG. 1, it is to be understood that this description is not to be limiting, as the invention is capable of a variety of modifications, the limitation being that there be at least two stages of steam injection. In this embodiment, a steam source line is intercepted by a modulating valve which, in turn, is controlled by a means, not shown, that is responsive to the presence of smoke in the burning gases. Reference is made to the U.S. Pat. No. 4,094,632, for a description of one such means which includes photo-electric apparatus. Another means includes instruments sensitive to the flow or pressure of the waste gas. As the need for smoke suppressant occurs, steam will flow normally through the first stage conduit to the flare stack as shown. As increased need for smoke suppressant occurs, the control system will cause the modulating valve to open further. Upon the flow or pressure thereof reaching a previously determined set point for a high flow or pressure switch (PSH) a logic circuit is placed into operation which will gradually open the normally closed valve 10 to a second stage steam input. Any additional stages will operate in the same manner.

Once the demand for steam decreases a low flow or pressure switch (PSL) will operate the valving in reverse by sequentially closing the staged valves.

That is, with decrease demand for smoke suppressant, the modulating valve will begin to close. Once the previously determined set point of PSL of the highest stage in operation is reached, its corresponding valve will de-energize and close.

Figure 2:
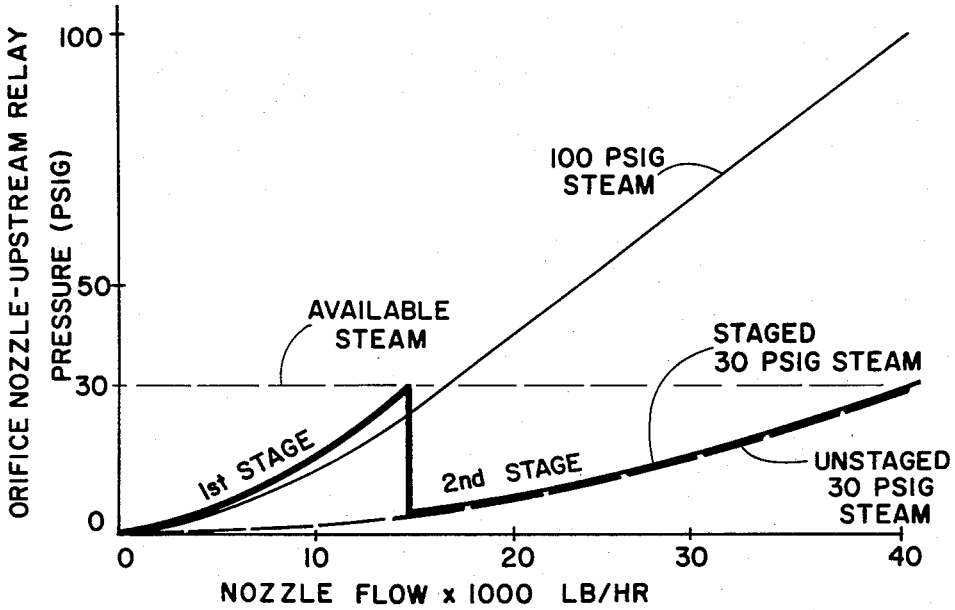
FIG. 2 is a graph of performance characteristics of the invention for a two-stage version.

FIG. 2 is a chart diagramming the pressure flow relationship of the steam at the injection nozzle for this invention compared with an unstaged steam system at high pressure, i.e., 100 psig and for unstaged low pressure steam, i.e. 30 psig. It is to be noted that in the staged low pressure steam concept of this invention, the set point of high flow-pressure switch (PSH) is such that before the second stage valve 10 will open the flow or pressure will be at a point approaching the maximum source pressure, such that upon opening the valve 10 the pressure drop will not fall significantly below the pressure required to maintain sufficient mechanical kinetic energy to provide efficient operation (MKE). Likewise, as the need for steam decreases and the pressure downstream of the modulating valve decreases, the set point of the low flow or pressure switch (PSL) will de-energize the valve 10 to a closed position.

It is to be understood that although only two stages are shown herein, additional stages operating in the manner set forth to control valve 20 and the third stage can be utilized.

Although steam is described herein as the preferred smoke suppressant it is to be understood that that term includes other fluids such as air or water which can be used as a smoke suppressant.

What is claimed is:

1. A flare stack for waste gases to be burned above the tip;

means to inject smoke suppressant from a steam source which does not exceed 50 p.s.i.g. into said burning gases through at least two separate manifolds and injection nozzles which are about the flare stack adjacent the tip;

a smoke suppressant conduit connected from a supply conduit to each manifold;

a normally closed valve means to control the quantity of smoke suppressant to each manifold except the first;

means to sense the need for smoke suppressant as a function of the need for smoke suppression;

a modulating valve in said supply conduit operated by said means to sense the need for smoke suppressant;

means downstream of said modulating valve to sense the flow or pressure of said smoke suppressant;

means to control the opening of each of said normally closed valve means as a function of the flow or pressure downstream of said modulating valve so that the pressure of said smoke suppressant downstream of said normally closed valve means will not be below that necessary to maintain at least sufficient mechanical kinetic energy in each of said manifolds and injection nozzles for smokeless burning of said waste gases.

2. A flare stack in accordance with claim 1 wherein said normally close valve means includes a plurality of normally closed control valves sequentially operable as a function of downstream flow or pressure of said modulating valve.

3. A method of staging steam, the pressure of which does not exceed 50 p.s.i.g., to a first and second means to inject steam into burning gases of a single flare tip for smokeless burning thereof; comprising the steps of:

sensing the need for said steam as a function of the need for smoke suppression;

controlling the admission of the total steam flow by a modulating valve, which operates between open and closed positions as a function of the sensed need;

supplying said steam from said modulating valve to said first steam injection means;

sensing the flow rate or pressure of the steam downstream of said modulating valve and, when the flow rate or pressure of said steam approaches a predetermined valve, opening a valve downstream of said modulating valve to said second steam injection means such that the resulting pressure of said steam downstream of said second stage valve will not be below that necessary to maintain at least sufficient mechanical kinetic energy to said second steam injection means.

* * * * *